US008355625B2

(12) United States Patent
Erasmus

(10) Patent No.: US 8,355,625 B2
(45) Date of Patent: Jan. 15, 2013

(54) SYSTEM FOR AND A METHOD OF HEATING WATER

(75) Inventor: Teuns Erasmus, Johannesburg (ZA)

(73) Assignee: Penduline 2 Trading (Proprietary) Limited, Bryanston (ZA)

( * ) Notice: Subject to any disclaimer, the term of this patent is extended or adjusted under 35 U.S.C. 154(b) by 592 days.

(21) Appl. No.: 12/667,947

(22) PCT Filed: Jul. 7, 2008

(86) PCT No.: PCT/ZA2008/000059

§ 371 (c)(1),
(2), (4) Date: Jan. 6, 2010

(87) PCT Pub. No.: WO2009/009804

PCT Pub. Date: Jan. 15, 2009

(65) Prior Publication Data

US 2010/0329651 A1 Dec. 30, 2010

(30) Foreign Application Priority Data

Jul. 6, 2007 (ZA) ..... 2007/05685

(51) Int. Cl.
*F24H 1/18* (2006.01)

(52) U.S. Cl. ..... 392/450; 392/445; 392/454

(58) Field of Classification Search ..... 392/445, 392/450, 454

See application file for complete search history.

(56) References Cited

U.S. PATENT DOCUMENTS

| | | | | | |
|---|---|---|---|---|---|
| 937,776 | A | * | 10/1909 | Dunham | 392/450 |
| 1,101,243 | A | * | 6/1914 | Bell | 392/461 |
| 2,237,808 | A | * | 4/1941 | Berg | 392/450 |
| 2,427,150 | A | * | 9/1947 | McCann | 392/461 |
| 2,823,649 | A | * | 2/1958 | Flynn | 122/14.22 |
| 4,416,222 | A | * | 11/1983 | Staats | 122/19.1 |
| 5,898,818 | A | * | 4/1999 | Chen | 392/449 |
| 6,292,628 | B1 | * | 9/2001 | Khalaf | 392/445 |
| 7,970,264 | B2 | * | 6/2011 | Grossbach et al. | 392/463 |

* cited by examiner

*Primary Examiner* — Thor Campbell

(74) *Attorney, Agent, or Firm* — Wenderoth, Lind & Ponack, LLP

(57) ABSTRACT

A system for heating water which includes a first container and a second container, an air-tight connection between upper ends of the first and second containers, each container including a respective water heating element, and a water outlet port and a water inlet port, a manifold which is operatively connected to the respective inlet and outlet ports of each container and which connects, in a controlled manner, the respective inlet port of each container to a pressurized source of cold water, and each container, at least in a respective upper volume thereof, and in the air-tight connection, containing a gas, and whereby cold water which is introduced into the first container via the manifold displaces gas via the air-tight connection from the first container into the second container thereby to expel warm water from the second container through the respective outlet port.

15 Claims, 7 Drawing Sheets

SYSTEM FOR AND A METHOD OF HEATING WATER

BACKGROUND OF THE INVENTION

This invention relates to a system for heating water and to a method of operating the system.

In a conventional geyser cold water is used to expel warm water which is drawn by a user from the geyser. The direct contact between the warm and cold water in the geyser has a cooling effect on the warm water in that heat is easily transferable from the warm water to the cold water. It is therefore seldom possible to draw from the geyser the full volume of warm water initially contained in the geyser.

As warm water is drawn from the geyser, a pipe connecting the geyser to a remote discharge point, for example a tap, is filled with warm water. Once the tap is closed so that the discharging of warm water from the geyser is stopped, the pipe remains filled with warm water until this warm water has cooled off. The heat energy contained in the warm water in the pipe is therefore wasted.

This invention attempts to address at least partly the aforementioned problems.

SUMMARY OF THE INVENTION

This invention provides a system for heating water which includes a first container and a second container, an air-tight connection between upper ends of the first and second containers, each container including a respective water heating element, a water outlet port and a water inlet port, a manifold which is operatively connected to the respective inlet and outlet ports of each container and which connects, in a controlled manner, the respective inlet port of each container to a pressurised source of cold water, and each container, at least in a respective upper volume thereof, and the air-tight connection, containing a gas, whereby cold water which is introduced into the first container via the manifold displaces gas via the air-tight connection from the first container into the second container thereby to expel warm water from the second container through the respective outlet port.

The gas may be a mixture of air and water vapour.

Each container may be of any suitable shape to reduce heat loss from the container.

The manifold may be modular in construction and may include an inlet unit, which is connected to the inlet port of each container, and an outlet unit which is connected to the outlet port of each container.

The heating element of each container may be located in a lower part of the container. A volume of water occurs in each container when in use so that the respective heating element is always immersed in water. Alternatively the heating element of each container may be located in a receptacle which is positioned inside the respective container and which has a discharge point which is higher than an upper surface of the respective heating element. It is preferred that the manifold delivers water directly to the respective receptacle. This helps to displace foreign matter from the element. Each container may also include a booster element for rapid heating of cold water introduced into the lower part of the container.

The system may include an electronic unit to control the operation of the manifold and of electrical components of the system such as the respective heating elements and valves. The electronic unit is preferably programmable.

Each container may be enclosed in a casing which contains a suitable thermal insulating material. Alternatively the first and second containers are enclosed together with the manifold and air-tight connection inside the casing. The casing may have a first connector port to connect the water source to the inlet unit, a second connector port to connect the outlet unit to a distribution network, and a third connector port which connects the electrical components of the system and of the manifold to the control unit. Another connector port may be provided for a manual valve to introduce air into, or to allow air to escape from, the system. A separate connector port may also be provided for a drain pipe.

The outlet of each container may include an elongate, flexible member which extends into an interior of the container and which is sealingly engaged at a first end with the container, and a buoyant member which is attached to an opposed second end of the flexible member so that the second end is positioned close to an upper surface of a body of water inside the container.

The pressurised source of cold water may be connected by a connector pipe at a predetermined position to a distribution network of warm water which has been sourced from the first or second containers so that the warm water can be pushed, using the pressure of the cold water, back into the first or second container. A motion sensor and a heat sensor may be connected to the distribution network with the heat sensor at a position which is adjacent to the outlet unit and the motion sensor at a position adjacent to a branch to a first service point. The water flowing from the source of cold water to the distribution network preferably flows through a valve which is positioned in a connector pipe. The valve is connected to the control unit which communicates with the sensors to regulate the flow of cold water directly into the warm water distribution network via a connector pipe.

The system may include a valve through which air can be allowed to be introduced, or to escape, from the system. Preferably the valve allows air to be introduced or to escape through the air-tight connection. The valve may be manually or electrically operable. The control unit is preferably connected to the valve when the valve is electrically operable.

The invention further provides a method of operating a water heating system which includes the steps of filling a first container with water, heating the water, causing cold water to flow into a second container which is air-filled, and transferring air displaced from the second container by the cold water into the first container thereby to expel heated water from the first container.

The method may include the step of connecting an upper end of the first container in an air-tight manner to an upper end of the second container.

The method may further include the step of causing warm water which has been discharged from the first container to be pushed back into the first container.

In the context of this invention "cold water" means water which is at a temperature which is lower than a temperature of the "warm water". The "cold water" may be sourced from a cold, warm or heated water supply.

BRIEF DESCRIPTION OF THE DRAWINGS

The invention is further described by way of examples with reference to the accompanying drawings in which.

DESCRIPTION OF PREFERRED EMBODIMENTS

Figure 1:
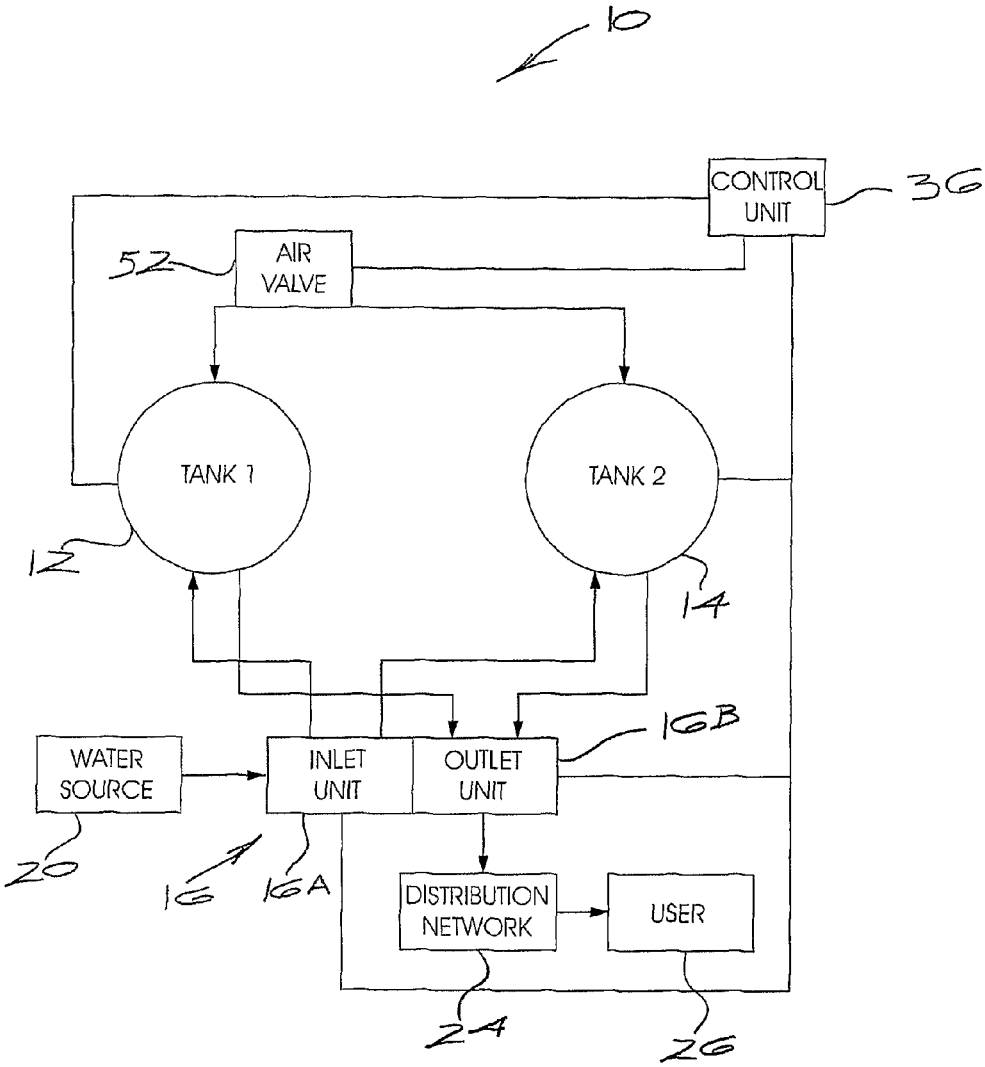
FIG. 1 is a schematic representation of a system, according to the invention, for heating water.
Figure 2:
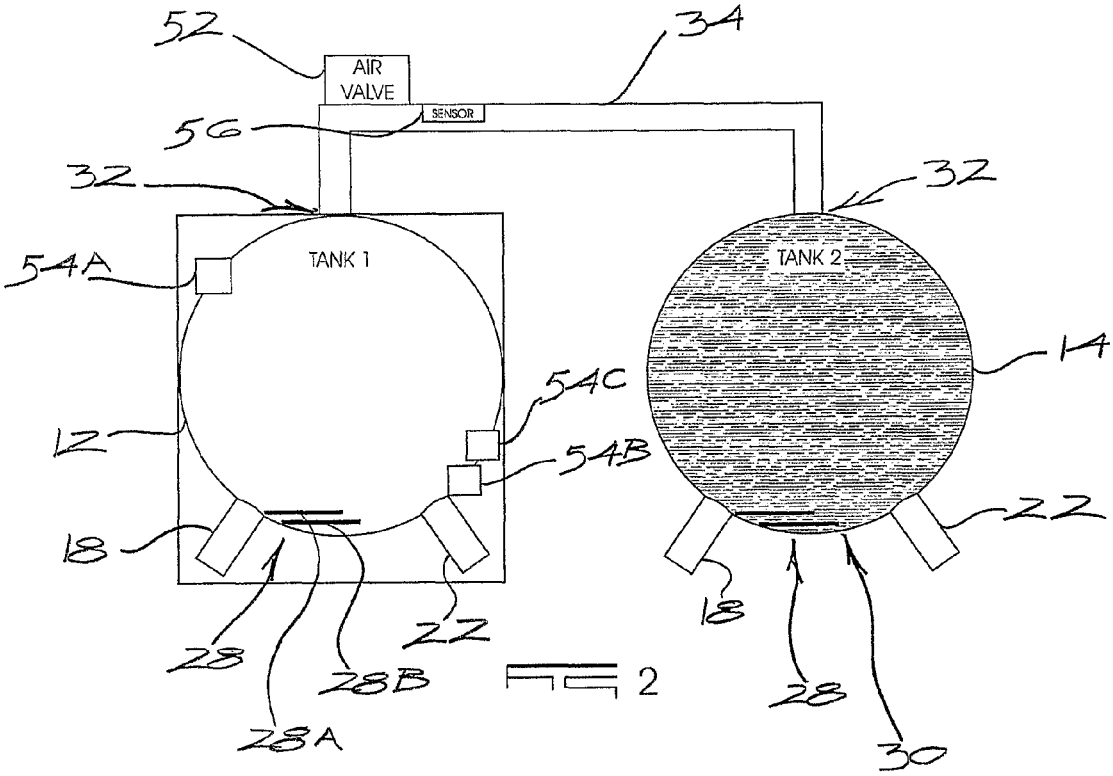
FIG. 2 is a schematic representation of components of a container used in the system.

FIGS. 1 and 2 of the accompanying representations illustrate a system 10 for heating water in accordance with the principles of the invention. The system includes a first container or tank 12 and a second container or tank 14 which are connected to a manifold 16. The manifold selectively connects a respective inlet port 18 of each tank to a pressurised source 20 of cold water and a respective outlet port 22 of each container to a distribution network 24 from which a user 26 can draw warm water. Each tank has a respective heating element 28 contained in a lower part 30 of the tank and a drain valve, not shown, of known construction which is not connected to the distribution network, through which the respective container can be selectively drained of its contents when required.

An upper end 32 of each tank is connected in an air-tight manner to a conduit 34.

A control unit 36 is connected, using any suitable technique known in the art, to the manifold 16 and to the electrical components of the tanks 12 and 14 and is used to regulate the respective operations of the manifold and of the electrical components.

The components used in the system 10 are substantially conventional and, apart from the manifold 16, are not further described herein. The materials used in the manufacture of the components are suitably chosen from materials which reduce heat loss from the system. The tanks 12 and 14 can be any suitable shape in order to present the smallest surface area to the environment, for a given volume, so that heat loss is reduced.

The manifold 16 includes an inlet unit 16A and an outlet unit 16B. The inlet unit connects the water source 20 to the inlet port 18 of each tank and the outlet unit connects the outlet port 22 of each tank to the distribution network 24.

Figure 4:
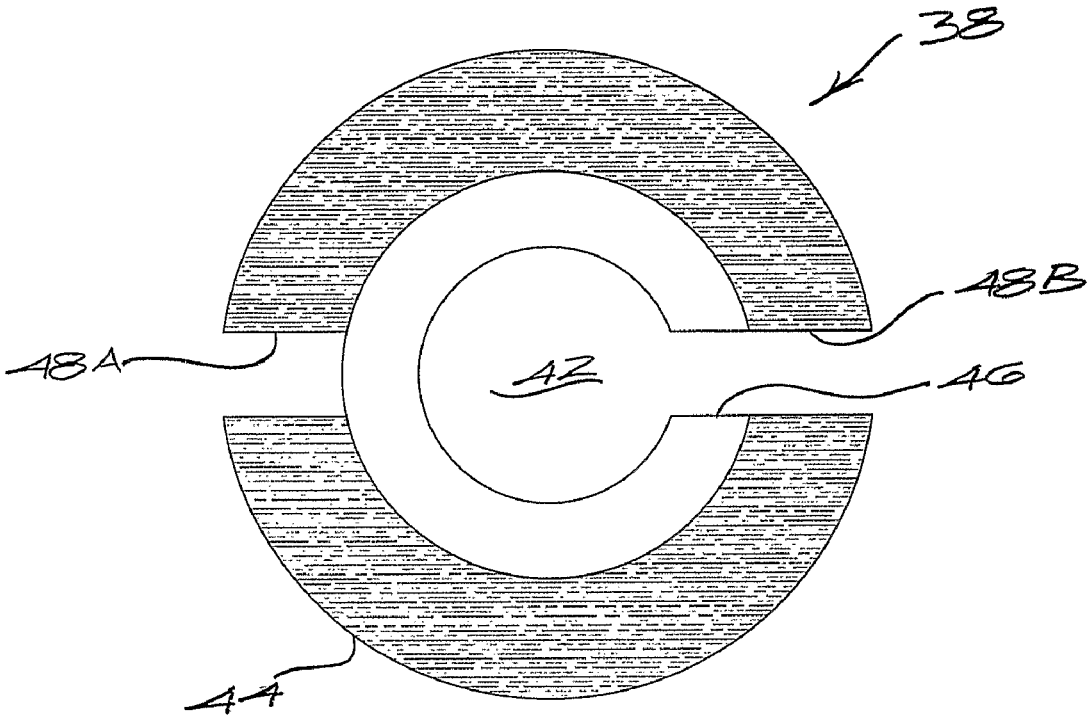
FIG. 4 is a cross-sectional side view of a manifold which is used in the system.

The inlet and outlet units 16A and 16B are substantially identical and for this reason only the construction of the inlet unit is described in greater detail hereinafter. The inlet and outlet units operate in tandem i.e. simultaneously. No water connectivity exists between the inlet and outlet units 16A and 16B FIG. 4 shows the construction of a distributor component 38 of the inlet unit 16A. The distributor component 38 includes an inner cylinder 40 which is rotatably mounted, in an axial sense, inside a chamber 42 of an outer cylinder 44. The chamber is of complementary shape to the inner cylinder which is fitted into the outer cylinder so that a seal is created between closely opposing surfaces of the cylinders. A suitable gear and motor assembly, not shown, is used to sealingly rotate the inner cylinder inside the chamber, as required, under the control of the control unit 36.

The inner cylinder 40 has a primary channel 46 and the outer cylinder 44 has two secondary channels 48A and 48B respectively. This is merely illustrative, not limiting. The number of secondary channels contained in the outer cylinder can be varied depending on requirement: for example one secondary channel for each inlet of each tank used in the system 10. By rotating the inner cylinder through a predetermined angle the primary channel can be selectively registered with a selected secondary channel. No flow of water is possible between the secondary channels of the outer cylinder 44.

The inner cylinder 40 is connected, using techniques known in the art, to the water source 20 and the secondary channels 48A and 48B are connected to the inlet ports 18 of the tanks. In the outlet unit 16B, the inner cylinder is connected to the distribution network 24 and the secondary channels 48A and 48B are connected to the outlet port 22 of each tank.

FIG. 2 shows the system 10 once installed. The second tank 14 is shown filled with water but initially both tanks and the conduit 34 will be filled only with a gas or air 50 which has been sourced from atmosphere. The respective inlet ports 18 of the tanks 12 and 14 have been connected to the inlet unit 16A, which has been connected to the water source 20, and the respective outlet ports 22 have been connected to the outlet unit 16B which has been connected to the distribution network 24. Once the respective upper ends 32 of each tank have been sealingly connected through the use of the conduit 34, substantially no air is allowed to escape from the system. An air valve 52 of known construction is associated using known techniques with the conduit 34 so that air can be allowed, in a controlled manner, to be introduced into, or to escape from, the system. Preferably the valve is electrically operated and is connected to, and controlled by, the control unit 36.

The volume of gas 50 in the system, consisting of a mixture of air and water vapour, is used to communicate the pressure of the water from the source 20, at least partly, to the respective tank from which warm water is being discharged. At a certain stage the volume of the warm gas has been reduced to a predetermined size and is positioned between the volume of pressurized water which has entered the tank 12 and the volume of warm water in the tank 14. The water will flow into the tank 12 until the volume of gas is compressed to a minimum size at which instant the influx of cold water into the tank stops. At this stage the gas is at the same pressure as the water from the source.

The system 10 should be set up initially so that as much air as is possible is contained inside the system. This will allow excess air to be bled from the system, if required, through the air valve 52 while the balance of air can be compressed to a predetermined value. Therefore, after the system 10 has been installed, the tanks 12 and 14 are filled with air which has been sourced from atmosphere. The system is now ready for the start of the first cycle in which the first tank of warm water is produced. Water is introduced into the second tank 14 to fill the tank to a predetermined level. The water in the tank 14 is allowed to heat up to the predetermined storage temperature while the air mixes with the water vapour to form a gas. As cold water from the source is introduced into the tank 12 the pressure of the gas 50 is increased to a similar level to that of the pressurized water from the source. The size of the volume of gas is thereby reduced to a predetermined value.

The charge tank 12 and the discharge tank 14 contain a number of sensors 54 which are monitored by the control unit 36 using conventional techniques. A first sensor 54A is used in each respective tank to sense when the water level in the tank has reached a predetermined maximum level when the tank is being filled. A second sensor 54B in each tank is used to sense when the water level in the tank has dropped to a predetermined minimum level, when the tank is being drained. The size of the volume of gas varies during operation in accordance with the temperature, which affects the pressure inside the system.

Once the water in the charge tank 12 has reached the predetermined maximum level the sensor 54A is activated and the control unit causes a realignment of the inlet ports 18 in the inlet manifold 16A whereby the inlet port 18 of the charge tank 12 is disconnected from the water source 20 and the inlet port 18 of the discharge tank 14 is connected to the water source 20. As the inlet unit 16A and the outlet unit 16B of the manifold operate in tandem the ports in the outlet unit 16B are simultaneously realigned. Thus the outlet port 22 of the discharge tank 14 is disconnected from the warm water distribution network and the outlet port 22 of the charge tank 12 is connected to the network.

The activation of the sensors 54A and 54B causes similar responses with respect to the alignment of the inlet unit 16A and outlet unit 16B. If the rising water level in the respective charge tank 12 has reached the predetermined maximum level the sensor 54A is activated. However, if the falling water level has reached the predetermined minimum level in the respective discharge tank 14 first the sensor 54B is activated.

A respective third sensor 54C is used to determine the temperature of the water at the bottom of each tank 12 and 14 so that the water temperature is kept substantially in a predetermined range through the operation of the respective heating element 28A by the control unit 36.

A respective fourth sensor 54D controls the heating of cold water entering the charge tank, through the operation of the respective water heating element 28B, to a temperature close to the storage temperature.

During installation the maximum or operational temperature of the warm water which must be supplied by the system 10 and the pressure of the water from the source 20 are programmed into the control unit 36. During the first cycle the control unit 36 allows the second tank 14 to fill with water drawn from the water source, initially the pressure of the gas 50 contained in the first and second tanks 12 and 14 is atmospheric which allows the second tank 14 to be filled relatively easily. As the second tank is filled with water from the source, the air displaced from the second tank is transferred to the first tank via the conduit 34. This increases the pressure of the air in the first tank and in the system.

At the start of the first cycle the control unit 36 causes the inlet port 18 of the second tank 14 to be connected to the water source 20 via the inlet unit 16A and the outlet port 22 of the first tank 12 to be connected to the outlet unit 16B. The heating element 28B in the tank 12 is energized. Simultaneously the inlet port of the second tank 14 is closed and the outlet port of the first tank 12 also closes. Once the water level inside the second tank reaches the first sensor 54A, the control unit causes the inlet port 18 of the second tank 14 to be disconnected from the water source while the outlet port 22 in the first tank 12 closes. Simultaneously the inlet port 18 of the first tank opens and the outlet port 22 of the second tank also opens.

The system 10 is now ready for warm water to be drawn by the user 26.

The control unit is programmed to monitor the sensors 54A and 54B and to align the manifold so that at any given time only one port 18 is connected to the water source.

Once the water in the second tank 14 has reached operating temperature, the control unit causes the inlet port 18 of the first tank 12 to be connected to the water source 20. Some water will flow into this tank due to the lower pressure of the gas 50 in the system. However, the influx of water into the tank causes the pressure of the air to increase to a level at which the pressure of the air is substantially equal to the pressure of the water from the source. At this point no further water will flow into the first tank.

The system 10 operates in cycles. In each cycle subsequent to the first cycle only one tank will be connected to the water source and only one tank will be connected to the distribution network 24. During each cycle, the control unit 36 causes the inlet port 18, for example of the first tank 12, to be connected to the water source 20 via the inlet unit 16A, and the outlet port 22 of the second tank 14 to be connected to the distribution network 24 via the outlet unit 16B. The flow of water from the outlet port of first tank is prevented by the outlet unit 16B and similarly the flow of water into the inlet port 18 of the second tank is prevented by the inlet unit 16A.

When water is drawn by the user 26, the flow of water out of the distribution network 24 causes a pressure drop in the second tank 14 which is communicated via the conduit 34 to the first tank 12. This drop in pressure inside the first tank allows cold water to flow from the water source 20 into the first tank. The sensor 54A indicates to the control unit 36 when the influx of water into the first tank has reached the predetermined maximum level which results in the disconnection of the inlet 18 from the water source.

The control unit now realigns the respective inner cylinders 40 of the inlet and outlet units 16A and 16B so that the inlet port 18 of the second tank is connected to the water source 20 and the outlet port 22 of the water-filled first tank is connected to the distribution network 24. The sensor 54D is activated causing the heating element 28B in the second tank to be activated to heat the cold water contained in the second tank to a level just lower than storage temperature. The sensor 54C is used to communicate this water temperature to the control unit 36 which in response thereto will control the operation of the heating element 28A which determines the level of heating up to the storage temperature.

The warm water contained in the second tank 14 is substantially insulated by the air and water vapour mixture contained in the connecting member 34 and the volume of air contained in the first tank 12 from the cold water introduced into the first tank 12. The cold water entering the tank 12 from the water source 20 is therefore not brought into direct contact with the warm water contained in the tank 14 and, as a result, transfer of heat from the warm water to the cold water is reduced.

Figure 3:
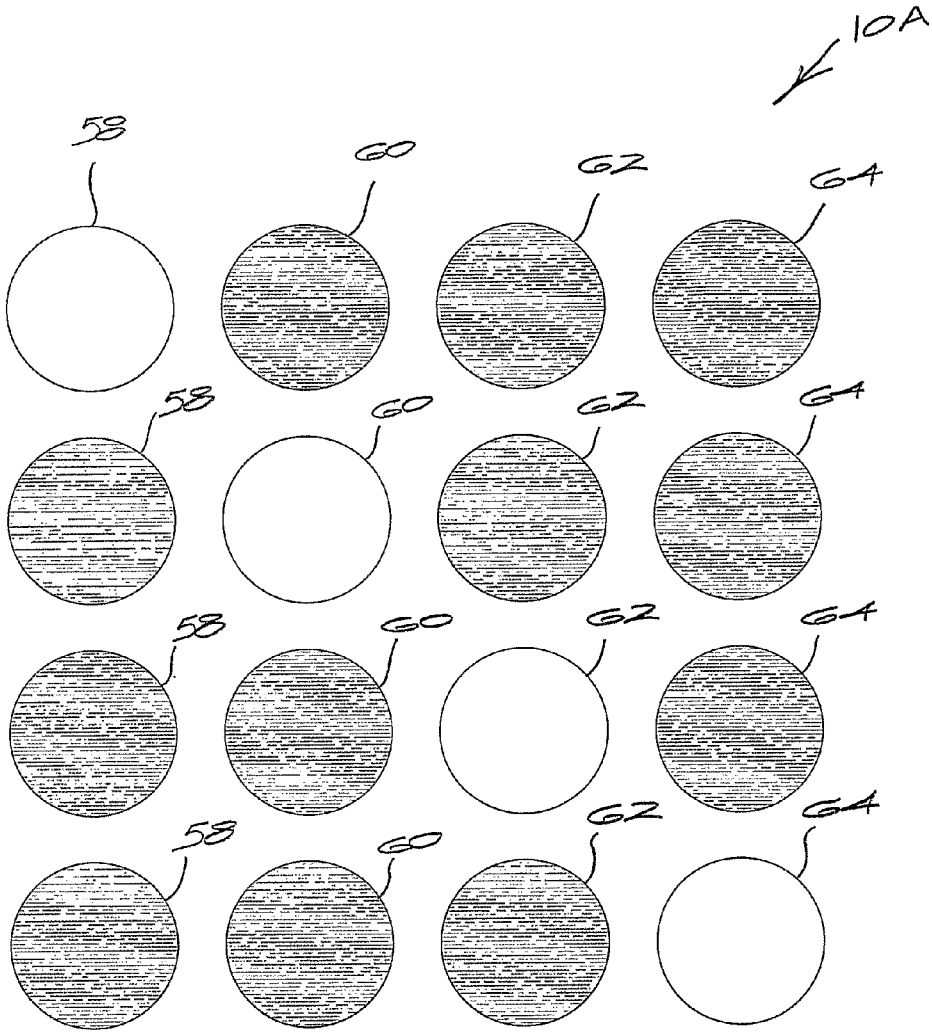
FIG. 3 is a schematic representation of various stages in a variation of the invention in which warm water is progressively drawn from a group of containers.

It can happen that more warm water than what is contained in a respective tank is demanded by the user 26. FIG. 3 represents a variation of the invention wherein four tanks 58, 60, 62, and 64 are used in a heating system 10A. The system 10A is constructed using the same components and techniques as in system 10. However the respective outer cylinders 44 of the inlet and outlet units 16A and 16B are suitably adapted so that each cylinder has four secondary channels 48 to allow the inlet and outlet ports 18 and 22 of each tank to be connected to the manifold 16.

The tanks 58, 60, 62, and 64 form a group in the system 10A with one of the tanks being filled with air, in this example the tank 58, and the remainder of the tanks with water. The water in the tanks can be heated progressively under the control of the control unit 36. The control unit is programmed selectively to drain all the warm water from the tanks, e.g. first the tank 60, then the tank 62 and thereafter the tank 64, in a cycle.

Referring to FIG. 3, in one cycle the tanks 58 to 64 are sequentially filled with air under the control of the control unit 36. At the beginning of the cycle, the tank 58 is filled with air and at least one of the tanks 60, 62 and 64 is filled with water. The control unit links the inlet port 18 of the tank 58 to the water source 20 and the outlet port 22 of the tank 60 to the distribution network 24. The remaining inlet and outlet ports of each tank are closed though the manifold. As described hereinbefore, the tank 60 is allowed to drain to a predetermined minimum level and the tank 58 is allowed to fill to a predetermined maximum level.

The control unit 36 now switches the manifold 16 after the tank 60 has been drained and connects the inlet port 18 of the tank 60 to the water source 20 and the outlet port 22 of the tank 62 to the distribution network 24. The remaining ports are closed through the manifold. The control unit also activates the heating element of the tank 58 so that the cold water in the tank is heated. Once the warm water of the tank 62 has reached the predetermined minimum level, the control unit switches the manifold so that the recently drained tank 62 can be filled with cold water from the water source 20 and the warm water contained in the tank 64 is connected to the distribution network 24. Once the tanks 64 and 58 have similarly been depleted of their warm water contents, the cycle is finished and a new cycle is started by the control unit 36.

In each tank the heating element 28A can be used together with a booster element 28B. The elements 28A are energized simultaneously, but the booster elements 28B are energized non-simultaneously. They are only used to heat up rapidly when an empty charge tank is being filled with cold water.

Figure 5:
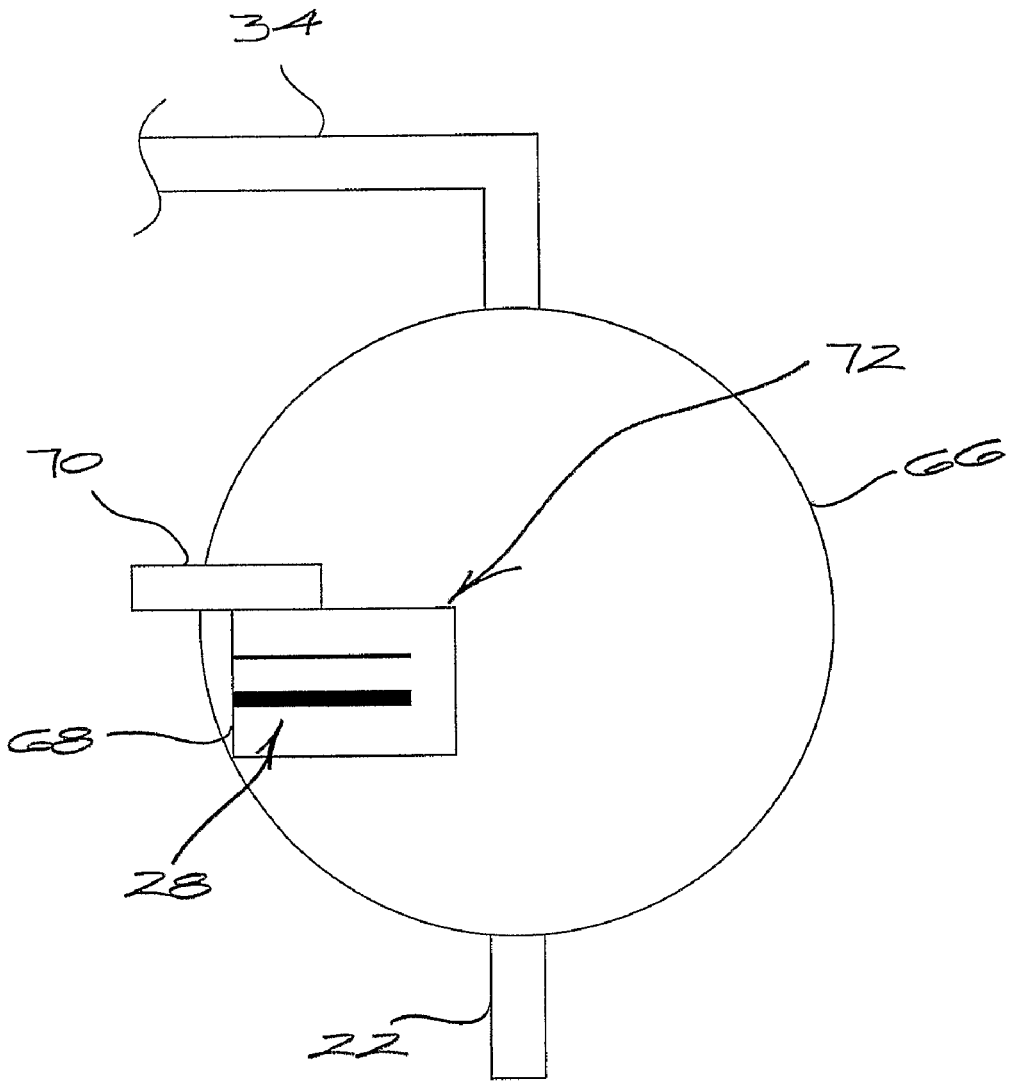
FIG. 5 is a schematic representation of a variation of the container.

FIG. 5 shows a tank 66 which is a variation of the tanks 12 and 14. Like reference numerals are used to indicate similar components. The heating elements 28A and 28B of the tank 66 are positioned in a receptacle 68 which is located inside the tank. An inlet port 70 is positioned so that the water supplied to the tank is fed to the receptacle which has a discharge point 72 which is higher than the heating elements 28A and 28B so that when the tank is drained of its warm water via a floating outlet (described in connection with FIG. 6), the heating element is still covered by water retained in the receptacle. Preferably the receptacle should be situated in a lower part of the container.

The control unit 36 is programmable using known techniques. It is possible to program the control unit, for example, to reheat the water contained in a tank to a predetermined temperature during predetermined intervals, or to maintain the temperature of the water contained in a tank within a predetermined temperature range and to increase the temperature of the water contained in a selected tank or in each tank to an elevated operating temperature only when water is drawn by a user through the distribution network 24. These examples are merely illustrative, not limiting, and are given to show different ways in which the control unit can be programmed.

A suitable casing 74 (see FIG. 1) can be used to increase the heat efficiency of each tank. A suitable thermal insulating material, not shown, can be used inside the casing to enclose a respective tank. The casing can also be used to enclose more than one tank and is suitably dimensioned so that the manifold and the air-tight connector are housed together with the tanks inside the casing so that any possible heat losses from the enclosed system are thereby minimised. Such a casing may typically only have three connector ports, viz a first port which leads to the inlet unit and which is connected to the water source, a second port which leads from the outlet unit and which is connected to the distribution network, and a third port which allows the control unit to be electrically connected to the tanks and manifold. Enclosing the tanks and manifold of the system may improve the overall appearance of the system and may reduce the time required to install the system. A wall of each container can also be double-layered with a vacuum between the layers to increase the heat efficiency of each tank.

The systems 10 and 10A can also be incorporated into an existing geyser system installed, for example, in a house, not shown. The system can be used to produce warm water which is fed into the geyser. The geyser is then used as a storage container from which warm water is drawn by a user. The systems 10 and 10A can transfer pre-heated water from an energy source, e.g. solar to a reservoir, like a geyser (refer as well to paragraph 0018 hereof).

Figure 6:
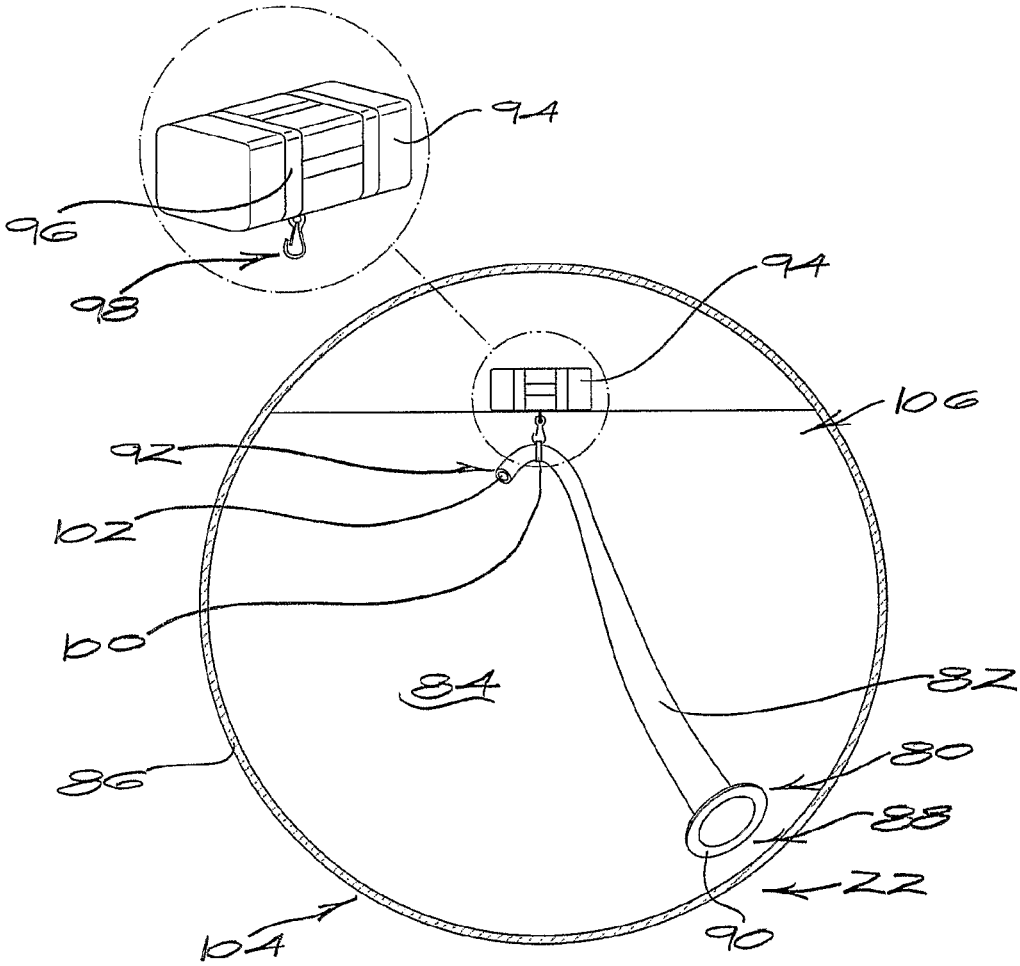
FIG. 6 is a perspective view, partly sectioned, of a floating member.

FIG. 6 shows a variation 80 of the outlet port 22. An elongate, flexible member 82 extends from an inner volume 84 of a tank 86 to an outer side of the tank. A first end 88 of the member has a flange 90 which surrounds the outlet port 22. An opposed second end 92 is secured to a buoyant member 94 which is manufactured from any suitable material which will allow the member to float on water inside the tank 86. Any suitable technique can be used to secure the second end 92 to the buoyant member. In one example a harness 96 is secured to the buoyant member. A clip 98 is pivotally attached to the harness and to a sleeve 100 which is secured to the second end 92. The second end, which can pivot relative to the buoyant member, is shaped so that a mouth 102 thereof points substantially towards a lower side 104 of the tank. When warm water is drawn from the tank through the outlet port 22, the member collects water from an upper region 106 of the water in the tank.

Figure 7:
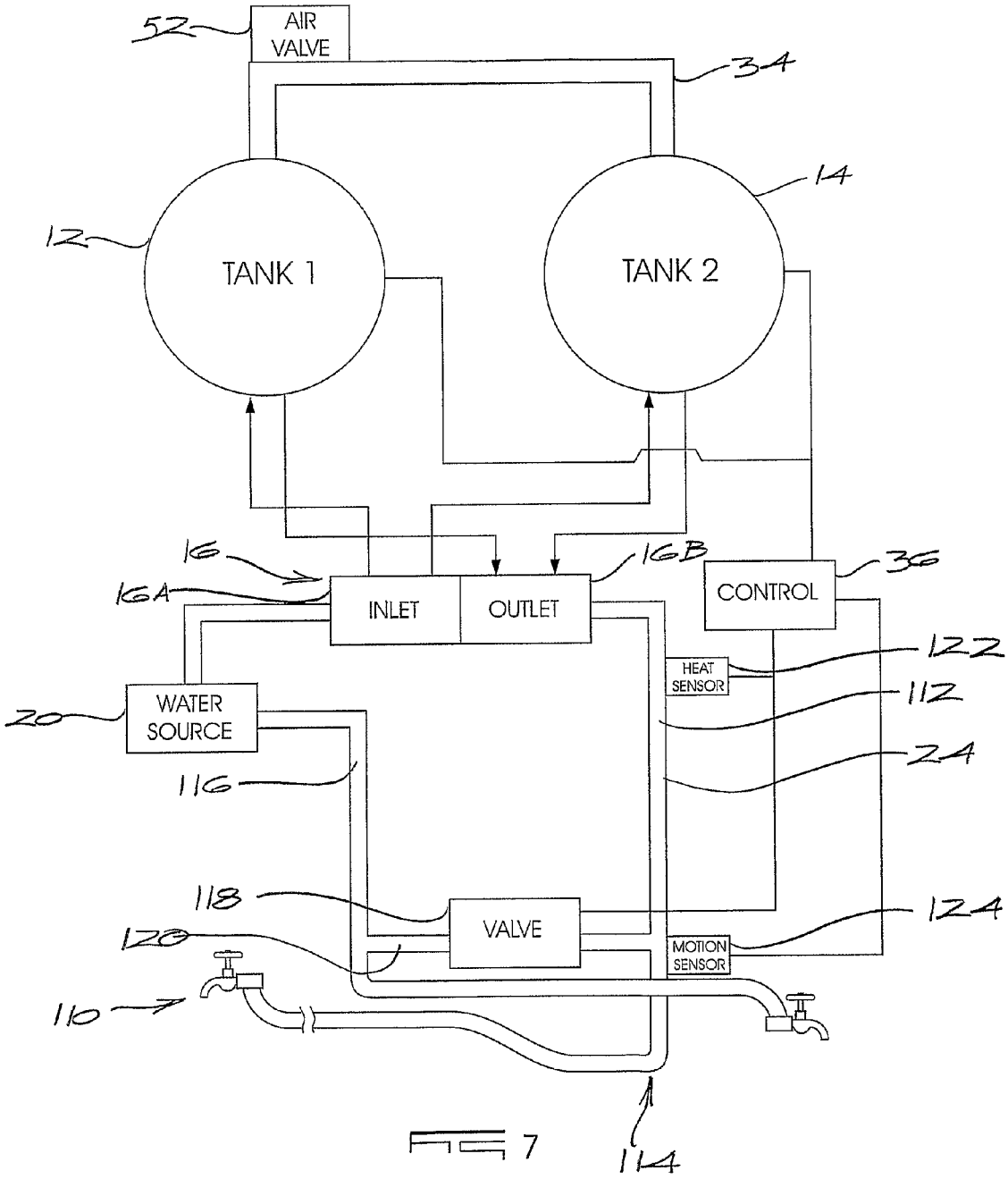
FIG. 7 is a schematic representation of a further variation of the system in which warm water is pushed back into the one of the containers.

FIG. 7 shows a variation 10B of the system. Like reference numerals are used to designate like components. As stated hereinabove, the warm water distribution network 24 guides warm water from the discharge tank 14 to one or more delivery points 110. The distribution network 24 includes a single pipe 112 which leads from the outlet unit 16B to a junction point 114 at which the pipe 112 is connected to a plurality of pipes which lead to the respective delivery points. The pipe 112 may run to the most remote delivery point with other delivery points located at branches on the pipe 112. As is practice a second distribution network 116 supplies cold water from the mains to the delivery points 110. A valve 118 is installed in a known manner in a connector pipe 120 which joins the distribution networks 24 and 116 to each other. The operation of the valve is controlled by a motion sensor 124 located in the pipe 112 at a position between the connector pipe and the branch connected to the delivery point 110. The motion sensor communicates with the control unit 36. A heat sensor 122 is connected to the pipe 112 at a position at which warm water exits the outlet unit 16B. The heat sensor is connected to the control unit in a conventional way.

When a user draws water from the system 10B, warm water will flow, for example, from the second tank 14 which acts as discharge tank to the respective delivery point 110. Closure of the delivery point causes warm water to stop flowing from the discharge tank 14. The motion sensor 124 communicates to the control unit that water has stopped flowing from the discharge tank 14. The control unit then actuates the valve 118 to open so that pressurized water from the second network 116 flows through the connector pipe 120 into the pipe 112. The second network 116 is connected to the pressurized water of the mains 20. By using any existing technique the flow rate of the pressurized water from the cold water source 20 via the connector pipe 120 into the warm water pipe 112 is reduced. The warm water is pushed backwards via the outlet unit 16B into the tank 14. When the cold water reaches the heat sensor 122 at the outlet unit, it communicates with the control unit which causes the valve 118 in the connector pipe to close and stop the flow of cold water between the two distribution networks 24 and 116.

The motion sensor 124 communicates to the control unit 36 when water is being drawn from one of the delivery points 110. The causes the control unit to close the valve 118. Cold water will then flow into the charge tank 12 and warm water will flow from the discharge tank 14 through the pipe 112 to the delivery point 110.

The system can be programmed to commence the first cycle after the elapsing of a predetermined period of time, for example once a year. The manifold 16 includes a designated secondary channel 48 which is connected to a pipe, not shown, which leads to a drain into which the respective contents of each tank 12 and 14 can be drained. Once the tanks have been depleted of their contents, the manifold is configured so that the ports 18 and 22 are not connected to the source 20 nor to the distribution network 24. The air valve 52 is then opened so that the tanks are vented and filled with air from atmosphere. After a predetermined amount of time has elapsed, the first cycle is commenced.

The invention provides a system wherein heat loss from warm water contained in a tank is reduced since cold water introduced into the system is not mixed with the warm water while it is being discharged. Instead, a charge tank is filled with cold water only after the discharge tank has been substantially emptied by draining the warm water content of the tank up to a predetermined minimum level. This increases the amount of warm water that can be drawn from the system and reduces heat loss from the system. During static phases cold water and stored warm water are kept in two separate tanks in the system. The tanks used in the system are modular in construction so that the capacity of the heating system can be increased as required, and so that defective modules can be isolated by the control unit or replaced by a user.

The invention claimed is:

1. A system for heating water which includes a first container and a second container, an air-tight connection between upper ends of the first and second containers, each container including a respective water heating element, a water outlet port and a water inlet port, a manifold which is operatively connected to the respective inlet and outlet ports of each container and which connects, in a controlled manner, the respective inlet port of each container to a pressurised source of cold water, and each container, at least in a respective upper volume thereof, and the air-tight connection, containing a gas, whereby cold water which is introduced into the first container via the manifold displaces gas via the air-tight connection from the first container into the second container thereby to expel warm water from the second container through the respective outlet port.

2. A system according to claim 1, wherein the gas is a mixture of air and water vapor.

3. A system according to claim 1, wherein the manifold includes an inlet unit which is connected to the inlet port of each container, and an outlet unit which is connected to the outlet port of each container.

4. A system according to claim 1, wherein each heating element is located in a lower part of the respective container.

5. A system according to claim 1, wherein each heating element is located in a receptacle which is positioned inside the respective container and which has a discharge point which is higher than an upper surface of the respective heating element.

6. A system according to claim 1, which includes an electronic control unit which controls the operation of the manifold and of each heating element.

7. A system according to claim 1, wherein each container is enclosed in a casing which contains a suitable thermal insulating material.

8. A system according to claim 2, wherein the first and second containers are enclosed together with the manifold and air-tight connection inside a casing which contains a suitable thermal insulating material, the casing having a first connector port which connects the water source to the inlet unit, a second connector port which connects the outlet unit to a distribution network, and a third connector port which connects electrical components of the containers and of the manifold to a control unit which controls the operation of the manifold and of each heating element.

9. A system according to claim 1, wherein each outlet port includes an elongate, flexible member which extends into an interior of the respective container and which is sealingly engaged at a first end with the container, and a buoyant member which is attached to an opposed second end of the elongate member so that the second end is positioned close to an upper surface of a body of water contained inside the container.

10. A system according to claim 3, wherein the pressurised source of cold water is connected at a predetermined position to a distribution network of warm water which has been sourced from the first and second containers so that the warm water can be pushed, using the pressure of the cold water, into the first or second container.

11. A system according to claim 10, further including a heat sensor which is connected to the outlet pipe of the distribution network adjacent to the outlet unit, a motion sensor which is connected to the outlet pipe at a position between the connector pipe and a branch to a first service point and a valve which is connected to the connector pipe through which cold water flows from a source to the outlet pipe and which is connected to, and controlled by, an electronic control unit, to regulate the flow of cold water directly into the outlet pipe of distribution network.

12. A system according to claim 1, further including a valve which allows air to be introduced into, or to escape from, the air-tight connection.

13. A method of operating a water heating system which includes the steps of filling a first container with water, heating the water, causing cold water to flow into a second container which is air-filled, and transferring air displaced from the second container by the cold water into the first container thereby to expel heated water from the first container.

14. A method according to claim 13, further including the step of connecting an upper end of the first container in an air-tight manner to an upper end of the second container.

15. A method according to claim 13, further including the step of causing warm water which has been discharged from the first container to be pushed back into the first container.

* * * * *